United States Patent [19]

Saint-Pierre et al.

[11] 4,224,759

[45] Sep. 30, 1980

[54] ANIMATED PULL TOY

[75] Inventors: Raymond M. Saint-Pierre, Hawthorne; Berne E. Danielsen, Pacific Palisades, both of Calif.

[73] Assignee: Mattel, Inc., Hawthorne, Calif.

[21] Appl. No.: 12,924

[22] Filed: Feb. 16, 1979

[51] Int. Cl.[3] ..... A63H 13/02

[52] U.S. Cl. ..... 46/105; 46/204; 46/141

[58] Field of Search ..... 46/105, 104, 103, 97, 46/110, 107, 99, 106, 141, 206, 102, 204

[56] References Cited

U.S. PATENT DOCUMENTS

| | | | |
|---|---|---|---|
| 1,891,816 | 12/1932 | Hewitt | 46/104 |
| 2,385,914 | 10/1945 | Generale | 46/104 |
| 2,535,230 | 12/1950 | Purdum | 46/105 X |
| 2,675,643 | 4/1954 | Ernst | 46/104 |
| 2,971,289 | 2/1961 | Reed et al. | 46/104 |
| 3,191,343 | 6/1965 | Goldfarb | 46/103 |
| 3,918,199 | 11/1975 | De Masi | 46/141 X |

*Primary Examiner*—Robert Peshock
*Assistant Examiner*—Mickey Yu

[57] ABSTRACT

An animated pull toy representing an animal and having legs which move as it is pulled. When released, the animal may be made to sit up and beg. When fed, the animal's tail wags rapidly.

10 Claims, 6 Drawing Figures

ANIMATED PULL TOY

BACKGROUND OF THE INVENTION

The background of the invention will be discussed in two parts:

1. Field of the Invention

This invention relates to toys and, more particularly, to animated pull toys.

2. Description of the Prior Art

There have been a myriad of toys developed over the years for use by children of all ages. Many of these toys have become classics and have been reproduced again and again. Those toys which have lasted have certain common characteristics. First, they provide a substantial amount of excitement for the child. Second they are well made and durable so that the child may play with them over a long period of time. Next, they are sufficiently inexpensive that they appeal to a broad market. More recently it has become very important that such toys be safe to use. Meeting all of these criteria has posed a substantial problem for many prior art toys.

There have been many pull toys devised over the years. These are often made of wood and are quite sturdy and inexpensive but in providing such advantages they are often able to perform only simple functions. Consequently, prior art pull toys usually entertain for but a short time. Many prior art pull toys have also been found to be unsafe by present standards.

It is an object of the present invention to provide a new and improved animated pull toy.

It is another object of the present invention to provide a sturdy, inexpensive, and safe pull toy for a child.

It is still another object of the present invention to provide a new and improved pull toy which performs a number of relatively complicated life-like actions.

SUMMARY OF THE INVENTION

The foregoing and other objects of the invention are accomplished by a pull toy which in a preferred embodiment emulates a dog that walks when it is led by a leash. When the child changes its pull on the leash, the dog sits up and begs. When fed a bone, the dog wags its tail rapidly. The walking motion is provided by a wheel which impels the rear legs forward and backward while winding a spring motor. The spring motor stores energy to wag the tail of the dog when a catch is released by placing an object in the mouth of the dog. The spring motor has a novel release mechanism which allows the dog to be pulled for long distances without overloading the spring motor. An unusual undulating surfaced gear which cooperates with a follower on the dog's tail provides the output for wagging the dog's tail.

Other objects, features, and advantages of the invention will become apparent from a reading of the specification taken in conjunction with the drawings in which like reference numerals refer to like elements in the several views.

DESCRIPTION OF THE PREFERRED EMBODIMENT

Figure 1:
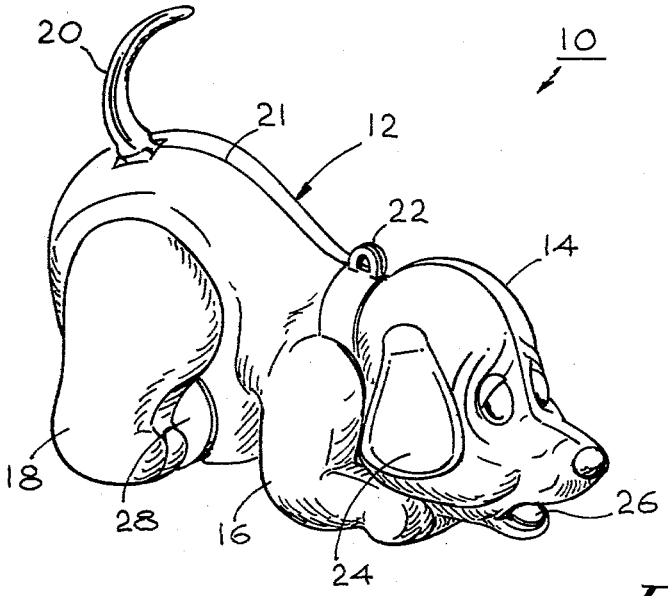
FIG. 1 is a perspective view of an animated pull toy constructed in accordance with the invention.

Referring now to the drawings and, more particularly, to FIG. 1, there is shown a perspective view of an animated pull toy 10 constructed in accordance with the invention. The pull toy 10, which is in a preferred embodiment an animated dog, includes a body 12, a head 14, front legs 16, rear legs 18, and a tail 20. The body 12, the head 14, and the front legs 16 are molded together in two halves in the preferred embodiment; the halves are snapped together along the line 21 shown in FIG. 1. The pull toy 10 also includes separately molded rear legs 18, a pair of ears 24, a tongue 26 which is connected to the interior mechanism, and an attachment 22 to which may be connected a string or other device emulating a leash by which the toy 10 may be pulled. All of these parts may be formed by well-known techniques from any of a number of well-known sturdy moldable plastic materials.

The toy 10 may be pulled across a relatively smooth surface by a child drawing a leash affixed to the attachment 22. As the toy 10 moves, the rear legs 18 move back and forth to simulate a walking action. When the child stops and places upward tension at the attachment 22, the toy 10 (which will be referred to as a dog hereinafter) sits up and appears to beg. When a toy bone 23 (see FIG. 2), which may be connected to the leash which is affixed to attachment 22, is inserted in the dogs mouth, the dog begins to wag its tail 20 rapidly. When the leash is pulled once again, the dog moves forward on all fours and once again simulates the motion of a dog walking.

Figure 5:
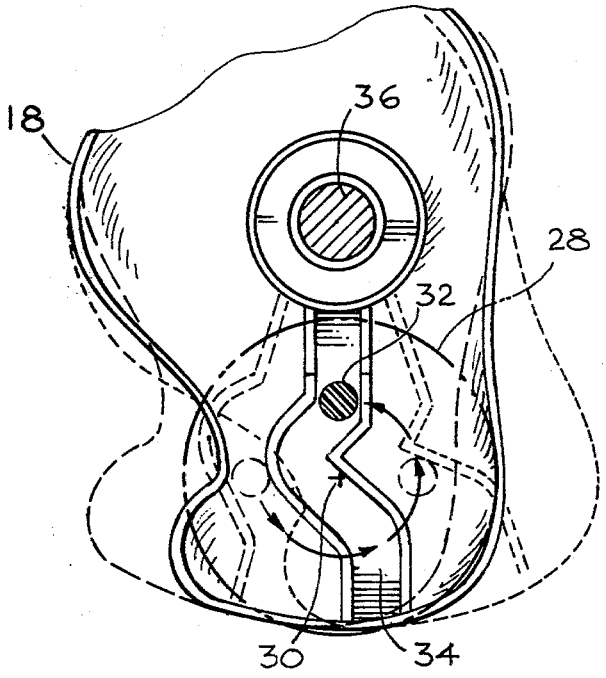
FIG. 5 is a cross-sectional view of one of the rear legs of the toy of FIG. 1 showing the mechanization thereof.

The means by which these various life-like functions are accomplished may be better understood by referring to the other figures of the drawing. For example, FIG. 5 shows a cut-away cross-sectional view of the mechanism by which the rear legs 18 are caused to move. This mechanism includes a pair of wheels 28 one of which is associated with each of the rear legs 18 and which are joined together by an axle 30 (shown in FIG. 5). In the position in which the dog is on all fours, the wheels 28 move against the ground surface rotating a projecting knob 32 which is carried within a shaped channel 34 molded into the side of each leg 18 adjacent the body 12. As may be seen, when the wheels 28 rotate in the direction shown by the arrows in FIG. 5, the knob 32 drives against the walls of the channel 34 thereby causing the rear leg 18 (which is suspended to rotate about an axis 36) back and forth. The shape of the channel 34 is selected so that the eccentric rotation of the knob 32 gives a particularly life-like movement to the legs 18 which simulates the movements of the rear legs of a dog.

Figure 2:
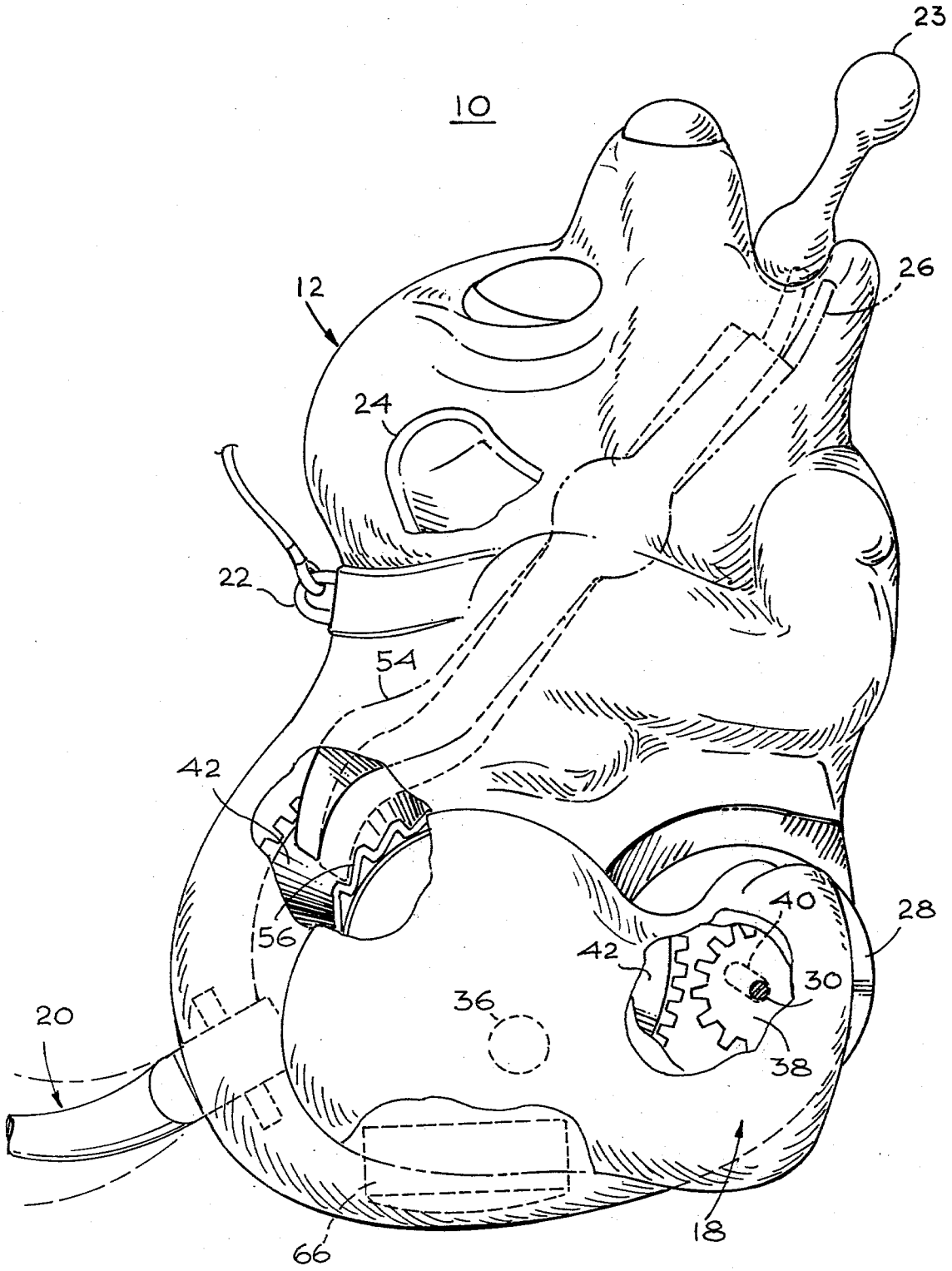
FIG. 2 is a side view of an animated pull toy constructed in accordance with this invention with portions cut away to disclose the operation of the interior mechanism thereof.
Figure 4:
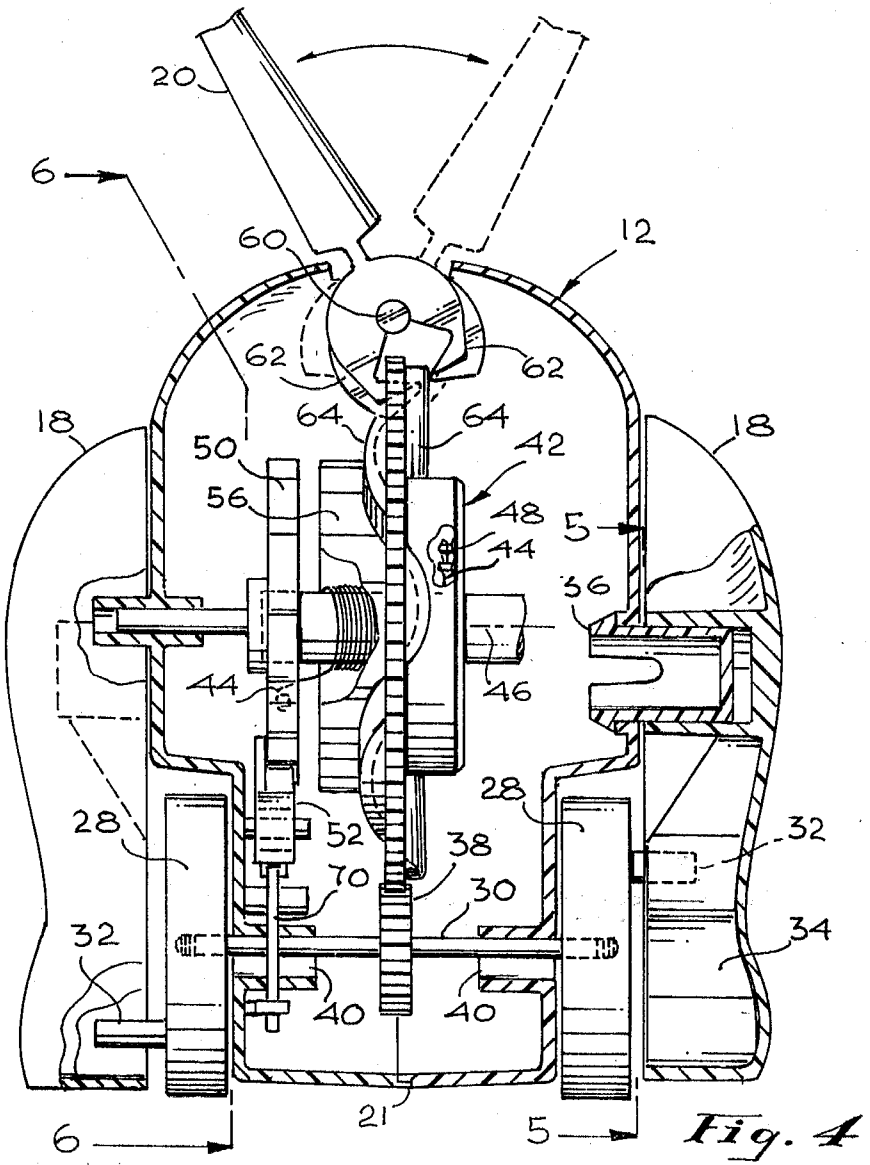
FIG. 4 is a partially cross-sectional view of the animated pull toy shown in FIG. 1 taken across its rear legs.

As may be seen in FIGS. 2 and 4, the rotation of the wheels 28 as the toy 10 is pulled forwardly rotates the axle 30 thereby rotating a gear 38 which is affixed to the axle 30. The axle 30 is mounted loosely in a channel 40 shown best in FIG. 2 so that the gear 38 may be impelled against a second gear 42 or withdrawn therefrom depending on the position of the toy 10. When the toy 10 is on all fours, the gear 38 is meshed with the gear 42; while if the toy 10 is sitting in the begging position, the gear 38, impelled by the force of gravity, falls away from the gear 42.

Thus, the forward motion of the toy 10 and the rotation of the wheels 28 causes the gear 38 to rotate the gear 42 thereby winding a spring 44 which is attached about the axis of rotation 46 of the gear 42. The spring 44 is connected at one end to the interior housing of the gear 42 at point 48 and at its other end to the interior surface of a coaxially mounted gear 50. The gear 50, although mounted to rotate upon its axis, is usually held in a fixed position by an escapement 52 (shown in FIG. 6). Consequently, the rotation of the wheel 28 as the toy 10 is pulled forward winds the spring 44 to build up a potential which may later be utilized to wag the tail 20.

Figure 6:
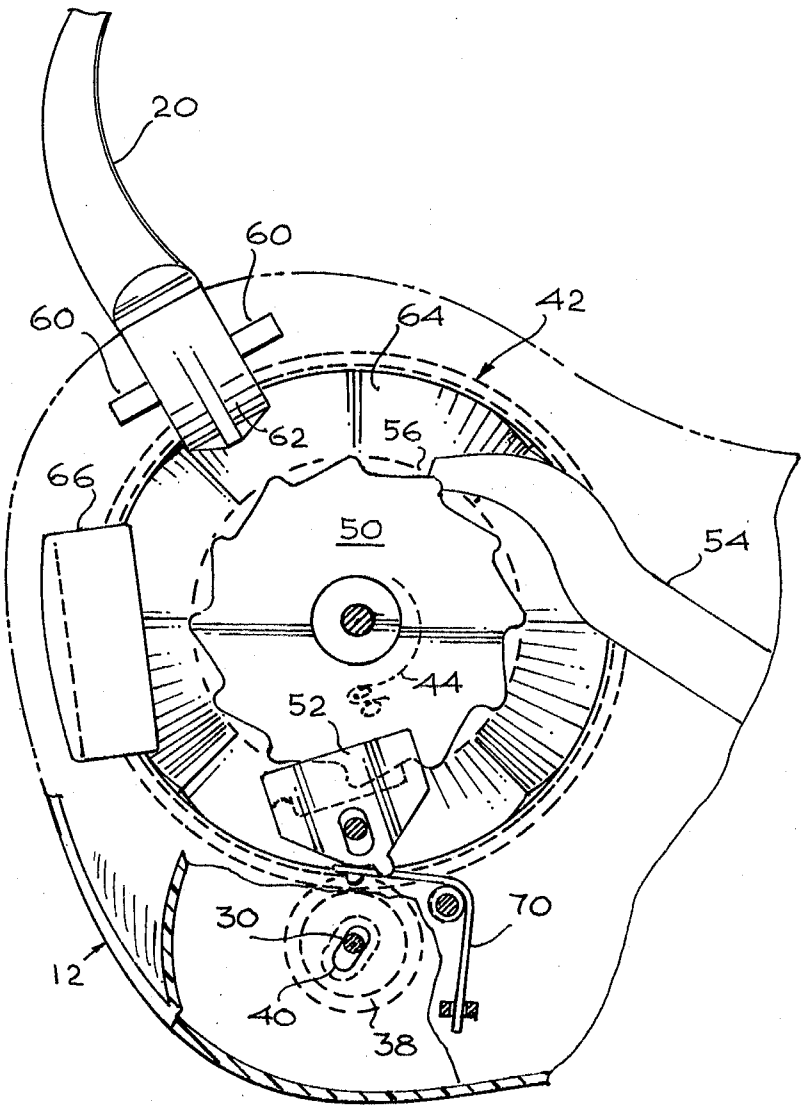
FIG. 6 is a partial cross-sectional view of the animated pull toy shown in FIG. 1 illustrating the operation of the mechanism which releases tension on the spring motor of the pull toy shown in FIG. 1.

The potential energy built up in the spring 44 is maintained as the gear 42 is wound by a long lever 54 shown in FIGS. 2 and 6 which engages a set of gear teeth 56 molded into the side of the assembly of which carries the gear 42. The lever 54 is held in place against the teeth 56 by a spring 58 and rotates about an axis 59. The lever 54 has molded at one end thereof the tongue 26, and depression of the tongue 26 will cause the lever 54 to lift from the teeth 56 thereby releasing the spring 44 and allowing the gear 42 to rotate rapidly. This rapid rotation can only take place in the sitting position of the dog when the gear 38 is withdrawn from engagement with the gear 42.

Figure 3:
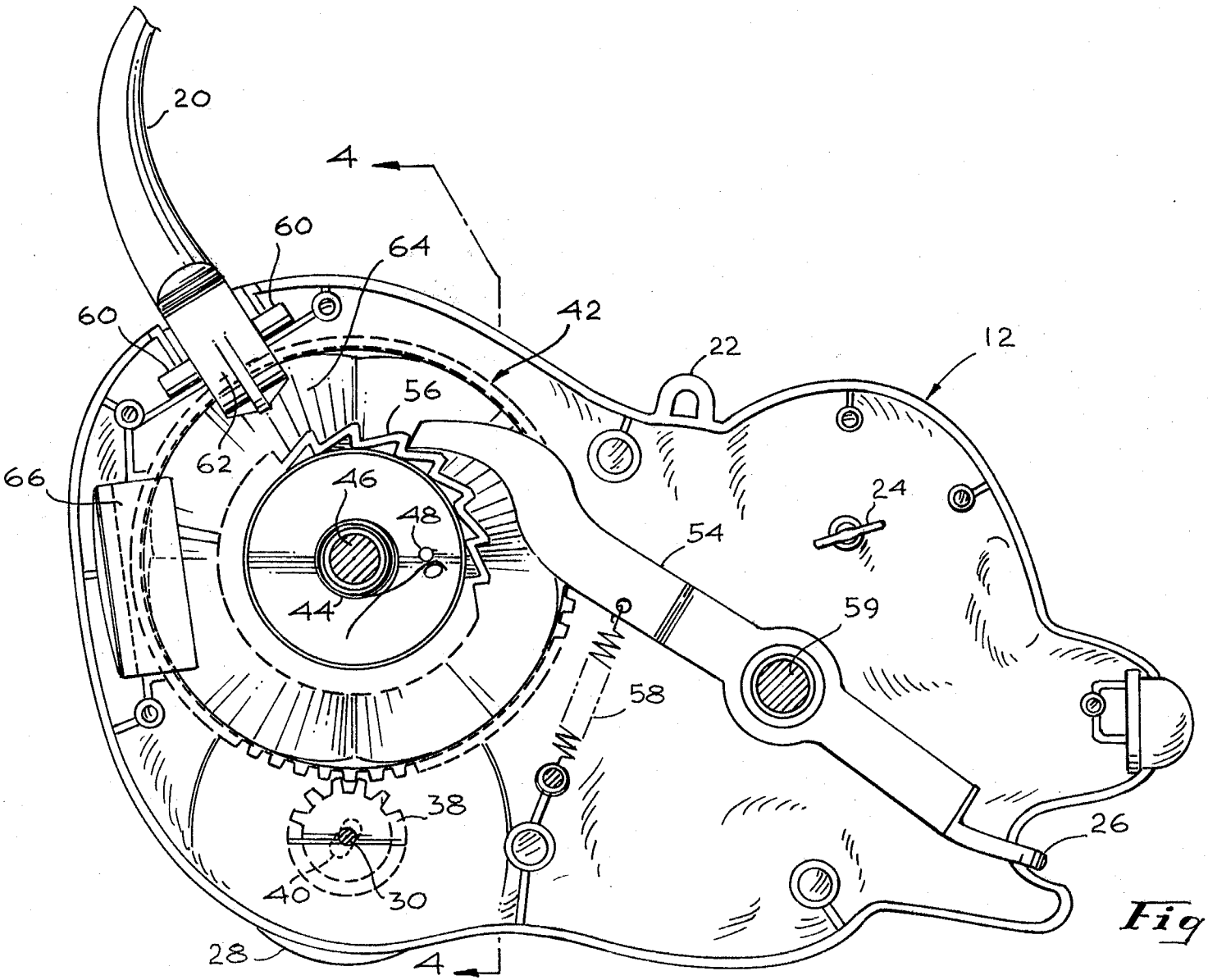
FIG. 3 is a cross-sectional view of the animated pull toy shown in FIG. 1 illustrating the interior mechanism thereof.

The rapid rotation of the gear 42 causes the tail 20 to move rapidly back and forth. The tail 20, as is best shown in FIG. 3, is attached for rotation within the body 12 of the toy 10 by a pair of protruding cylindrical knobs 60. As may be best seen in FIG. 4, the tail 20 has a pair of arms 62 which extend on either side of opposing surfaces 64 of the undulating disk carrying the gear 42. The surfaces 64 are so prepared that as the gear 42 rotates, surfaces 64 provide essentially a sinusoidal back and forth motion which is applied against the arms 62 thereby rotating the tail 20 about the knobs 60. This rotation causes the tail 20 to appear to be wagging. As explained, the rapid rotation of the gear 42 is caused by placing the bone 21 in the dog's mouth. Consequently, the dog appears to be wagging its tail rapidly in response to receiving a bone.

The dog is caused to rise from the walking to the sitting position upon upward urging by the leash fixed to the attachment 22. The force of gravity acts upon a weight 66 which may be of lead or other heavy material positioned to the extreme rear of the body 12 of the dog. The surface of the body 12 has a contour such that the lower rear of the dog is essentially a section of a cylinder. When the leash is pulled upward to start the movement, the force of gravity acting upon the weight 66 causes the dog to rotate so that it appears to sit up upon its haunches as is shown in FIG. 2. Obviously, pulling upon the leash affixed to attachment 22 will cause the dog to swing forward into the walking position and the wheels 28 to press against the ground surface. By increasing the weight, the dog may be made to sit up when the leash is released.

The spring motor including the gear 42 and its mounting arrangement, the spring 44, and the gear 50 has a unique mechanism which assures that the spring 44 is not overloaded. This mechanism includes the escapement 52 which fits against the teeth of the gear 50 thereby holding it in a fixed position as the spring 44 winds up. The escapement 52 is impelled against the teeth of the gear 50 by a spring 70 (see FIG. 6) which is mounted to the inside of the body 12. The amount of force applied by the spring 70 against the piece 52 is selected so that when a particular tension on the spring 44 is reached the force applied against the escapement 52 by the teeth of the gear 50 will be sufficient to overcome the force of the spring 70 and allow the gear 50 to slip thereby releasing some of the tension built up in the spring 44. This novel release arrangement allows the pull toy to be moved for varying distances which may be quite long without over extending the spring 44.

As explained above, the various parts of the toy 10 may be constructed of moldable plastic although the springs, axles, and weight are preferably of metal. The particular plastics chosen should be those providing a sturdy and enduring play toy for children. Particular portions of the toy such as the tail and the surfaces 64 of the gear 42 may advantageously be constructed of a plastic selected to provide relatively slick surfaces to facilitate the particular motions of those parts.

Obviously, other materials and construction techniques could be used to provide an animated pull toy such as that described herein. Furthermore, various changes might be made in the form of the pull toy without departing from the inventive concepts. Thus, while there has been shown and described a preferred embodiment, it is to be understood that various other adaptations and modifications may be made which fall within the spirit and scope of the invention.

What is claimed is:

1. A pull toy comprising a hollow body representing an animal, a pair of legs suspended by the body, means for causing the legs to emulate the movement of the legs of an animal as the toy is pulled, means for winding a spring motor as the toy is pulled, a tail mounted to the body, and means for causing the tail to wag in response to the operation of the spring motor.

2. A pull toy as claimed in claim 1 in which the tail is rotatably mounted to the body, the means for causing the tail to wag comprises a disk having an undulating surface mounted within the body to be driven by the spring motor, and the tail comprises a portion which projects into the body and is mounted to follow the undulating surface.

3. A pull toy as claimed in claim 2 further comprising a head having a mouth, and means for operating the spring motor in response to the insertion of an object into the mouth.

4. A pull toy comprising a hollow body representing an animal; a pair of legs suspended by the body; means for causing the legs to emulate the movement of the legs of an animal as the toy is pulled; means for winding a spring motor as the toy is pulled, including a disk mounted to rotate about its axis, a gear mounted coaxially with the disk, a spring wound about the axis of the disk, the spring being affixed at one end to the disk and at the other end to the gear, and means for releasing the tension on the spring so that it will not overload; a tail mounted to the body, and means for causing the tail to wag in response to the operation of the spring motor.

5. A pull toy as claimed in claim 4 in which the means for releasing the tension comprises an escapement, and means for holding the escapement in engagement with the gear at a pressure less than the overload limit of the spring.

6. An animated pull toy representing an animal comprising a body, a head having a mouth, a pair of legs connected to the body, means for moving the legs when the toy is pulled to emulate a walking animal, means for causing the toy to emulate a sitting animal when the toy is released, a tail, and means responsive to placing an object in the mouth for causing the tail to wag.

7. An animated pull toy as claimed in claim 6 in which the means for causing the tail to wag comprises a motor contained within the body, means linking the motor to the tail, and means for operating the motor when an object is placed in the mouth.

8. An animated pull toy as claimed in claim 7 in which the motor is a spring motor; and further comprising means for winding the spring motor comprising a wheel positioned to contact the ground when the toy is pulled, and a gear driven by the wheel to wind the spring motor; and in which the means linking the motor to the tail comprises a disk with an undulating surface connected to be driven by the motor, and a portion of the tail which is a follower for the undulating surface; and the means for starting the motor comprises a mechanical switch means for releasing the motor having an actuating mechanism positioned in the mouth.

9. An animated pull toy as claimed in claim 6 in which the means for moving the legs comprises a pair of wheels mounted to contact the surface over which the toy is pulled, a projection from each wheel, and a channel in each leg in which the individual projections move as the toy is pulled.

10. An animated pull toy as claimed in claim 6 in which the means for causing the toy to emulate a sitting animal comprises a rounded surface extending around the lower rear of the body, and a weight suspended within the body at the extreme rear between the bottom and the top thereof.

* * * * *